US010444708B2

(12) United States Patent
Cardot

(10) Patent No.: US 10,444,708 B2
(45) Date of Patent: Oct. 15, 2019

(54) DISPLAY MODULE INCLUDING ELEMENTS MOVABLE AROUND DEFORMABLE LINKS, ASSOCIATED DISPLAY SYSTEM AND TIMEPIECE INCLUDING SUCH A DISPLAY SYSTEM

(71) Applicant: CSEM CENTRE SUISSE D'ELECTRONIQUE ET DE MICROTECHNIQUE SA—RECHERCHE ET DÉVELOPPEMENT, Neuchâtel (CH)

(72) Inventor: Francis Cardot, Neuchâtel (CH)

(73) Assignee: CSEM Centre Suisse d'Electronique et de Microtechnique SA—Recherche et Développement, Neuchâtel (CH)

( * ) Notice: Subject to any disclaimer, the term of this patent is extended or adjusted under 35 U.S.C. 154(b) by 0 days.

(21) Appl. No.: 15/691,419

(22) Filed: Aug. 30, 2017

(65) Prior Publication Data

US 2018/0067457 A1 Mar. 8, 2018

(30) Foreign Application Priority Data

Sep. 5, 2016 (CH) ..... 1143/16

(51) Int. Cl.

| | |
|---|---|
| ***G04B 19/06*** | (2006.01) |
| ***G04B 19/00*** | (2006.01) |
| ***G04B 45/00*** | (2006.01) |

(52) U.S. Cl.

CPC ..... *G04B 19/06* (2013.01); *G04B 19/00* (2013.01); *G04B 45/0023* (2013.01)

(58) Field of Classification Search

CPC .. G04B 19/20; G04B 19/205; G04B 45/0038; G04B 45/0069

See application file for complete search history.

(56) References Cited

U.S. PATENT DOCUMENTS 2,426,079 A 8/1947 Bliss
4,601,585 A * 7/1986 Farley ..... G04B 19/042 368/238

(Continued)

FOREIGN PATENT DOCUMENTS

| | | |
|---|---|---|
| CH | 705 612 A2 | 4/2013 |
| EP | 3 070 538 A1 | 9/2016 |
| FR | 2 882 162 A1 | 8/2006 |

OTHER PUBLICATIONS

International Search Report dated Feb. 24, 2017, issued in corresponding Swiss Application No. 01143/16, filed Sep. 5, 2016, 4 pages.

*Primary Examiner* — Daniel P Wicklund

(74) *Attorney, Agent, or Firm* — Christensen O'Connor Johnson Kindness PLLC

(57) ABSTRACT

The present invention relates to a display module including a fixed frame and at least two substantially rigid display organs. The display organs each include a portion displaying a pattern, said display portions being complementary to one another such that it forms said pattern in at least one relative position of said display organs. Furthermore, at least one of the display organs is secured and movable relative to the frame via a deformable link at least between a first resting position, in which the display portions are separate from one another, and a display position, in which said display portions are counter-affixed to one another to form and display said pattern. Lastly, said display organ(s) movable relative to the frame cooperate with an actuating push-piece arranged to transmit a movement force of this display organ by elastic deformation around its deformable link(s) from said resting position toward said display position.

13 Claims, 4 Drawing Sheets

(56) References Cited

U.S. PATENT DOCUMENTS

| | | | | |
|---|---|---|---|---|
| 5,161,130 | A | 11/1992 | Sato et al. | |
| 6,229,768 | B1 | 5/2001 | Nakazawa et al. | |
| 6,262,947 | B1 * | 7/2001 | Pulver | G04B 19/065 368/223 |
| 7,420,885 | B2 * | 9/2008 | Claret | G04B 19/065 368/223 |
| 9,001,627 | B2 * | 4/2015 | Giguet | G04B 19/00 368/220 |
| 9,244,436 | B2 * | 1/2016 | Hartzband | G04B 45/0023 |
| 2008/0239884 | A1 * | 10/2008 | Muraji | G04B 47/044 368/232 |
| 2011/0019507 | A1 * | 1/2011 | Muraji | G04B 19/065 368/220 |
| 2014/0313868 | A1 * | 10/2014 | Takematsu | G04B 29/027 368/232 |

* cited by examiner

DISPLAY MODULE INCLUDING ELEMENTS MOVABLE AROUND DEFORMABLE LINKS, ASSOCIATED DISPLAY SYSTEM AND TIMEPIECE INCLUDING SUCH A DISPLAY SYSTEM

FIELD OF THE INVENTION

The invention relates to the general field of microtechnology, and in particular the manufacture of parts by silicon etching. The invention more particularly relates to a mechanical display module including a plurality of elements movable relative to one another around at least one deformable link.

The invention also relates to a display system including at least one said display module as mentioned above as well as a timepiece including such a display system.

The display module and the display device according to the invention are particularly applicable in the horology industry, more particularly to produce dials for driven watches or clocks.

BACKGROUND OF THE INVENTION

Analog display systems, in particular with hands, have been known and used for decades in a multitude of applications in order to procure a direct indication, for example on a graduated scale, a dial or another system for detecting a measuring value of a physical property such as speed, temperature, pressure, intensity, voltage or resistance, any item of information, or, and more likely, most commonly to measure time.

In the large majority of cases, the hands of a display device are made up of a rigid unitary body secured to a rotating staff moved by a movement, for example a clockwork movement in the case of a timepiece. With each rotational pitch of the rotating staff, the hand performs a corresponding rotation, at least one of its free ends describing a trajectory with a circular section thus pointing, in each of its positions on the circular trajectory, to information indicating a measured physical value, a time, or in general, any item of information to be indicated to a user. The indication is thus essentially done in the longitudinal axis of the hand at one and/or the other of its opposite ends in collaboration, if applicable, with an underlying display, for example a scale.

Generally known, in particular for clocks, are mechanical display systems, for example with pallet-stones, that indicate time information by aligning figures printed on the pallet-stones, the latter being pivoted around a staff by gravity during the release of blocking bolts at each time to be indicated.

Other alternative displays actuated by mechanical systems have also been proposed in the state of the art, essentially in the clockwork field. Examples include, among others, the digital display of the "pegboard" type of the Opus 8 model, marketed by the company Harry Winston SA, or the digital device for displaying the current hour by rotating a disc underlying a dial provided with an aperture as proposed in Swiss patent application CH 691833 A5.

These different displays all have the drawback of proceeding from a complex structure of various superimposed elements and requiring actuating mechanisms in addition to the basic clockwork mechanism, to which these actuating mechanisms are to be coupled, which disrupts the operation of the clockwork movement, or at the very least negatively affects its energy consumption.

To date, however, no display devices are known with a simple unitary structure allowing a direct digital display, if applicable without associated hands, provided with an animating capacity without disruptions of the primary display and indication function or actuating or animating mechanism complementary to the basic clockwork movement of the timepiece such as a watch or clock.

FIELD OF THE INVENTION

One aim of the invention is to propose the production of an animated display module, more particularly for the mechanical display of the current hour, and based on a single mechanical part that does not require any modification of a basic clockwork movement of the timepiece with which the display module is associated.

One particular application of the invention consists of producing an animated watch dial mechanically selectively displaying the current hour in a digital or other form.

Another aim of the invention is to provide a display system including such a display module and an actuating device that is easy to implement without modifying a basic clockwork movement, as well as a timepiece provided with such a display system.

To that end, the present invention proposes a display module including a fixed frame and at least two substantially rigid display organs. This display module is characterized in that:

- said display organs include a portion displaying a pattern, said display portions being complementary to one another such that it forms said pattern in at least one relative position of said display organs,
- at least one of the display organs is secured and movable relative to the frame via a deformable link at least between a first resting position, in which the display portions are separate from one another, and a display position, in which the display portions are brought closer to one another, preferably counter-affixed to one another to form and display said pattern,
- said display organs movable relative to the frame include an actuating push-piece suitable for transmitting a movement force of this display organ by elastic deformation around its deformable link(s) from said resting position toward said display position.

In the context of the invention, "rigid display organs" refers to elements of the display module participating in the periodic display of a time and made up of a material having a Young's modulus greater than 2.3 GPa.

Advantageously according to the invention, said display organs, the frame and the deformable links form a monolithic piece. In other words, the elements of the display module are formed from a single material without assembly.

The display module according to the invention may for example be made by molding and/or machining metal alloys, glass, ceramics ($Al_2O_3$), machinable and/or photocurable hard polymers (epoxy, PEEK).

According to one advantageous embodiment, the display module of the invention is advantageously made from a monocrystalline or polycrystalline silicon. The display module may thus advantageously be made using silicon deep etching methods.

In one embodiment, the display module of the invention includes n display organs, n being an integer greater than 1, at least one display organ being secured to the frame and immobile relative thereto.

Advantageously in this embodiment, the actuating push-piece is movable relative to the frame via a deformable link.

According to one embodiment of the inventive organ, at least one display organ may include several deformable links with the frame. Procuring several deformable links in particular makes it possible to limit the number of degrees of freedom of a display organ relative to the frame, for example in translation or rotation.

According to the various embodiments of the invention, and particularly in the context of a display module made from silicon, the deformable links are preferably made up of flexible blades with a width comprised between 2 and 50 microns, the thickness of the frame and display organ(s) being greater than 30 microns. This dimensioning thus effectively imparts an elastic nature to the flexible blades forming the deformable links, whereas the portions with a thickness greater than the frame and display organs are completely rigid and lack any elastic nature.

According to a second object, the present invention also relates to a display system including a display module as previously described, and an actuating device arranged relative to said display module to transmit a motive force on the actuating push-piece so as to cause a movement of the movable display organ(s) from the resting position to the display position.

In one particular embodiment, the actuating device includes a cam or a catch, said actuating device being rotatable around a rotation staff and arranged relative to the actuating push-piece such that said cam or said catch exerts, in at least one angular position around a rotation staff, on the actuating push-piece, a force able to mobilize said push-piece. Preferably, said cam or catch is for example kinematically connected to the hours wheel of a clockwork movement, the rotation staff being shared with that of the wheel.

According to one particular embodiment, the display system of the invention may include a plurality of display modules, in particular a plurality of display modules dedicated to displaying a time or any integer numerical value.

In one embodiment dedicated to horology, the display system may in particular include a plurality of said display modules arranged concentrically around a rotation staff of the actuating device, combined with the staff of the hours wheel, each to display a time, such that said actuating device successively cooperates with an actuating push-piece of each of the modules.

If applicable, the actuating device may also include a plurality of cams or catches in order to display a plurality of items of information at the same time. In an application to a timepiece dial, the actuating device of the display system may thus include a first cam or catch kinematically connected in rotation to the hours wheel, for example on the hour-wheel, of a clockwork movement and a second cam or catch kinematically connected to the minute-wheel of the clockwork movement, for example secured to the minute wheel.

As one particular example, it is possible to consider a simultaneous display of the hours and minutes by 5 minute brackets by superimposing two cams respectively connected to the hour-wheel and the minute-wheel mounted coaxial and freely rotating relative to one another around a central rotation staff shared with a display module configured to numerically display twelve hours or an arrangement of twelve individual display modules, each displaying an hour, concentrically positioned around the central rotation staff with the actuating device rotatable around this staff at the center of the display module or the arrangement of modules.

In one alternative embodiment of the display system according to the invention, the actuating device may also be a contactless actuating device by electrostatic, thermal or magnetic effect on the actuating push-piece of the display organ(s).

Lastly, a third object of the present invention relates to a timepiece, characterized in that it includes a display system as previously described. In this context, the actuating device of the display system is preferably kinematically connected to the hour-wheel and/or to the minute-wheel of a clockwork movement and the display module(s) are arranged to display a time.

DESCRIPTION OF THE DRAWINGS

The invention will be better understood upon reading the detailed description of one example embodiment done in reference to the appended figures, in which.

DETAILED DESCRIPTION

The present invention relates to an analog animated display module 1 for any type of information or depiction, in particular, but not exclusively, for displaying numerical information as shown and described below in FIGS. 1 to 4. The invention also relates to an analog animated display system including at least one such display module 1, as well as a timepiece including such a display system for the purpose of displaying an item of time information, for example.

Although one privileged application of the invention relates to the field of horology, it is not limited to displaying an item of time information and may also be implemented in any field requiring the use of a system for displaying an item of information or any depiction in an animated form.

Figure 1A:
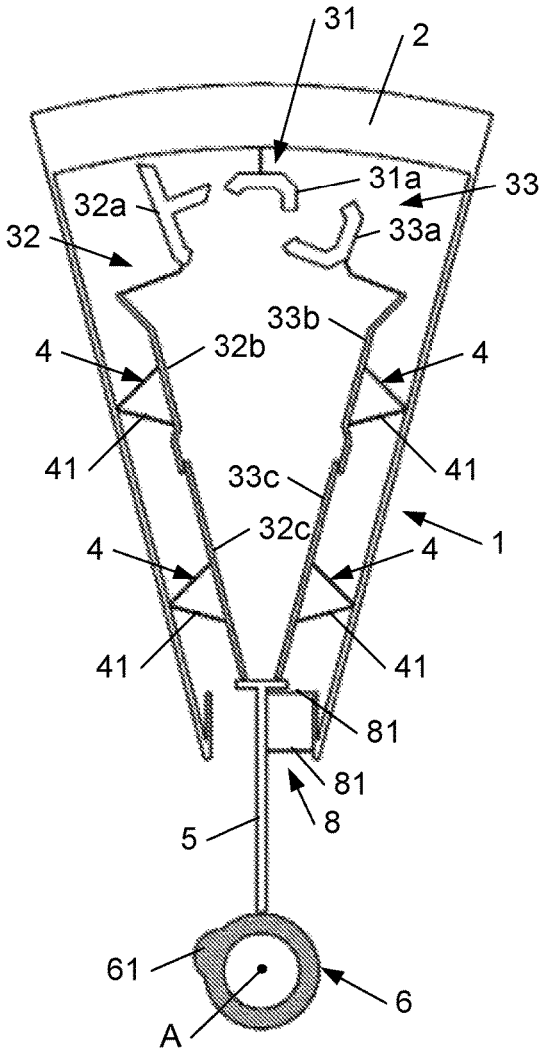
FIGS. 1A and 1B show a top view of a display module according to the present invention in a first embodiment, in the resting position and the display position, respectively.
Figure 1B:
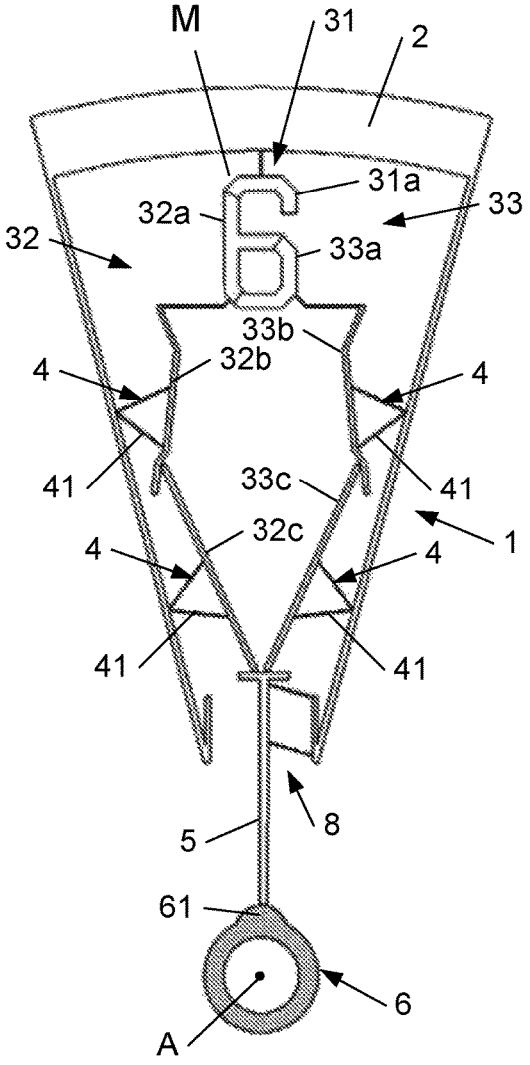

FIGS. 1A and 1B show a display module 1 according to the invention in a first embodiment. In this first embodiment, the display module 1 consists of a numerical display module for a pattern M such as a figure or a number including a fixed frame 2 to which at least two display organs, in the case at hand three display organs 31, 32, 33 in the example of FIGS. 1A and 1B to form the FIGURE "6" (FIG. 1B). The display organs 31, 32, 33 are secured to the frame 2 and each include a portion 31*a*, 32*a*, 33*a* displaying the pattern M, said display portions being complementary to one another such that they form said pattern in at least one relative position of said display organs 31, 32, 33.

To that end, the display organs 31, 32, 33 are secured to the frame 2 and the organs 32, 33 are also movable relative to the frame 2 via at least one deformable link 4 formed by at least one flexible blade 41 between a first resting position, shown in FIG. 1A, in which the display portions of the display organs 31, 32, 33 are separated from one another, and a display position, shown in FIG. 1B, in which said display portions 31*a*, 32*a*, 33*a* are counter-affixed to one another to form and display the pattern M, in the case at hand a FIGURE "6".

The movement of the display organs 32, 33 relative to the frame 2 around their deformable link 4 between the resting and display positions advantageously according to the invention results from the cooperation of said display organs 32, 33 with an actuating push-piece 5 arranged relative to the frame 2 and the display organs to transmit a force able to cause a movement of said display organs by elastic deformation around its deformable link(s) 4 following the action of an actuating device 6 separate from the display module 1, such as a cam 61 rotatable around a staff A in FIGS. 1A and 1B, on the actuating push-piece 5.

In the example embodiment of FIGS. 1A and 1B, the movable display organs 32, 33 advantageously include at least one actuating lever 32*b*, 33*b* including an arm secured at one end of the display portion 32*a*, 33*a* and able to pivot relative to the frame 2 via a deformable link 4, in the case at hand a deformable pivot, formed by two flexible blades 41 joined at one of their ends to the frame 2 and secured at their second end to said arm, which cooperates by periodic or planar bearing, if applicable by an intermediate lever 32*c*, 33*c* also linked to the frame 2 by a deformable pivot link 4, with the actuating push-piece 5, itself also secured to the frame 2 and movable relative thereto via a deformable structure 8 formed by two parallel flexible blades 81 and forming a deformable parallelogram.

It should be noted that although the display module 1 of FIGS. 1A and 1B includes intermediate levers 32*c*, 33*c*, these levers are nevertheless not essential and their presence in the display module depends fundamentally on the particular design thereof, the desired movement amplitudes for the display organs 32, 33 as well as the particular dimensions of the actuating levers 32*b*, 33*b* and the actuating push-piece 5.

The display module 1 of the invention is advantageously made up of a monolithic piece formed from a rigid material, which, in the context of the present invention, refers to any material having a Young's modulus greater than 2.3 GPa. To that end, one preferred material for producing the display module 1 of the invention is monocrystalline or polycrystalline silicon, from which it is easily possible, for example using deep etching methods (in particular DRIE, Deep Reactive-Ion Etching), to form the frame 2 and the display organs 31, 32, 33 connected to one another by at least one deformable link, in particular advantageously resulting from the formation, during the deep etching method, of one or several flexible blades 4 with a width comprised between 2 and 50 microns, the thickness of the frame 2 and the display organ(s) preferably being greater than 30 microns.

Figure 2:
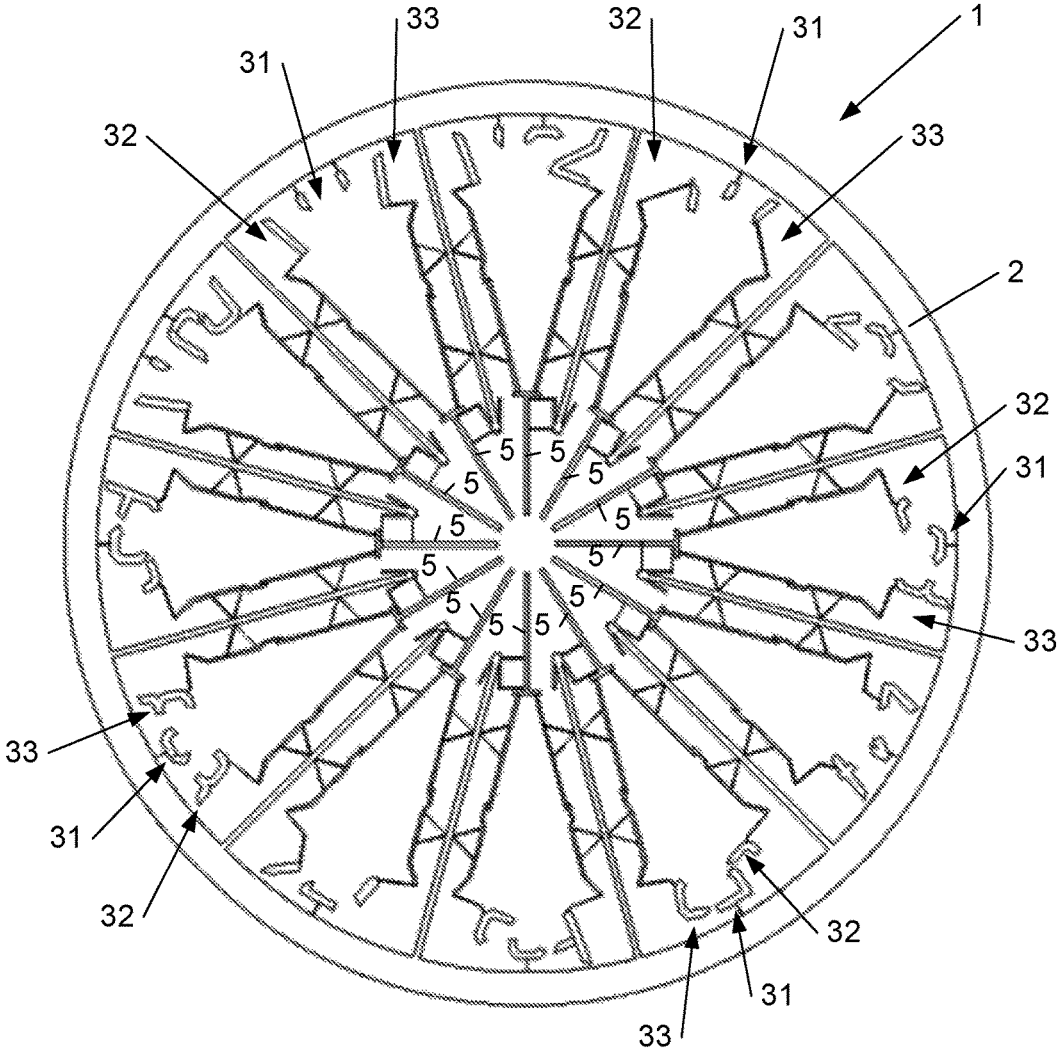
FIG. 2 shows a top view of a display module according to the present invention in a second embodiment, in the resting position, the display module making up a complete display dial of the hour for a timepiece.

A display module 1 according to the invention may in particular be used to produce a display system of the dial or dial portion type of a timepiece to indicate a time in a digital display form. By way of specific examples, it is first possible to produce a display dial by quarters, every 3 hours at 3, 6, 9 and 12 o'clock, using 4 individual display modules 1 as shown in FIGS. 1A and 1B respectively forming the numerical display "3, 6, 9 and 12" as pattern, or to produce a traditional 12-hour display dial as shown in FIG. 2, the circular display module including sub-modules similar to the individual display module of FIGS. 1A and 1B on a circular frame 2.

In both cases, the frame 2 of the display module 1 can be fixed on a dial, a disc or directly on the middle of a watch case for a skeleton watch by any appropriate means, and in particular gluing or welding. By way of actuating device 6, one including one or several cams 61 is kinematically linked to the hour-wheel and pivots around a staff A, for example centered at the dial of the watch, like in a traditional display with hands.

The operation of such a display system is described below in reference to FIGS. 1A and 1B. During the rotation of the ring 6, the cam 61 pushes the free end of the actuating push-piece 5 (FIG. 1B), which acts as a follower contact, and causes a translational movement of the actuating push-piece 5, which then pushes on the intermediate levers 32*c*, 33*c*, which pivot relative to the frame 2, and thus bear by their end opposite the push-piece 5 on the arm of the actuating lever 32*b*, 33*b*, which pivots in turn, driving the movement of the display portions 32*a*, 33*a* toward the display position in which said display portions adjust with the portion 31*a* to form the pattern "6" in FIG. 1B.

After the passage of the cam 61, the follower contact of the actuating push-piece 5 returns to bear on the ring 6, pushed by the return forces of the flexible blades 41 from its deformable link 4 to the frame. The display for portions 32*a*, 33*a* then separate to return toward the resting position (FIG. 1A), and the pattern is no longer visible.

An animated display system is thus produced including movable display portions according to a predetermined period to create a visual animation effect within the display.

Figure 3A:
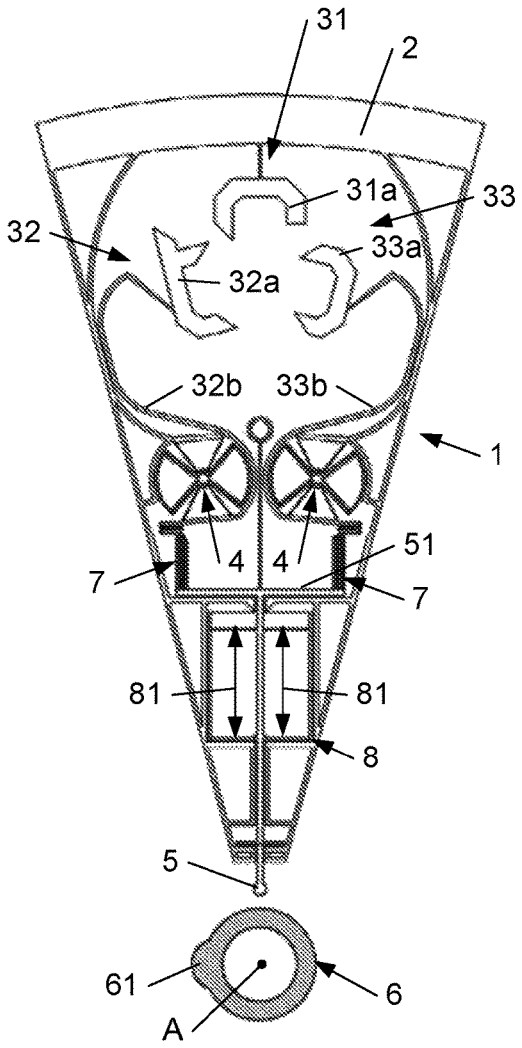
FIGS. 3A and 3B show a top view of a display module according to the present invention in a $3^{rd}$ embodiment similar to that of FIGS. 1A and 1B, in the resting position and the display position, respectively.
Figure 3B:
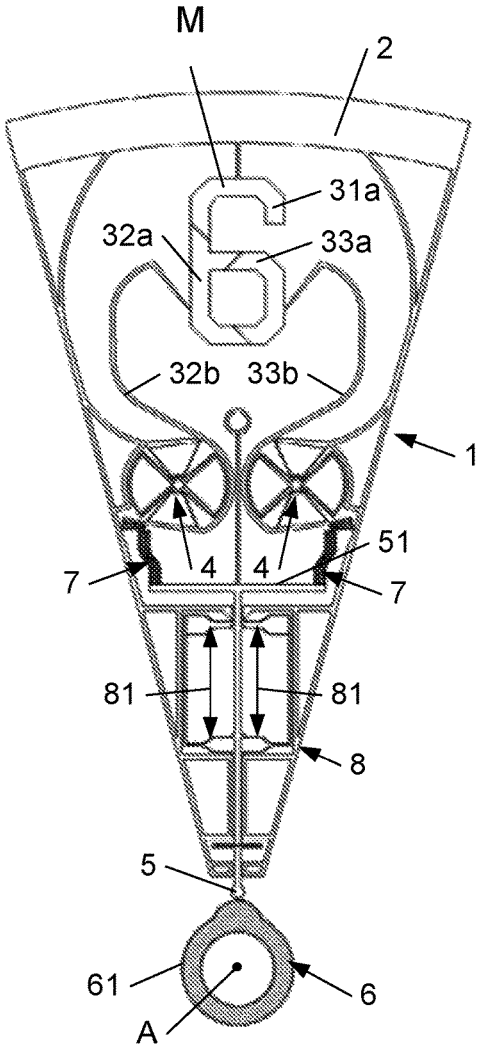

An alternative embodiment of the display module 1 of FIGS. 1A and 1B is shown in FIGS. 3A and 3B. In this alternative, the movable display organs 32, 33 and their display portions 32*a*, 33*a* are directly connected to the actuating push-piece 5. The display organ 31 remains identical to that of FIGS. 1A and 1B.

This embodiment has the particularity of not having any interruption in the chain of command of the movement, from the actuating push-piece 5 to the display portions 32*a*, 33*a*. There is no friction within the display module 1 due to the movements, only deformations, therefore a minimal energy loss. The display portions 32*a*, 33*b* are connected to the upper ends of two levers 32*b* and 33*b*, in rotation around deformable links 4 in the form of "butterfly" flexible pivots 42 secured to the frame 2. The lower end of each of the levers is directly connected through a set 7 of winding flexible blades to a plate 51 of the actuating push-piece 5, which is also secured to the frame 2 by a linear translation guide structure 8 with flexible blades 81.

The operation and animation of such a display module 1 is identical to that of FIGS. 1A and 1B and is actuated by an actuating organ able to cooperate with the push-piece 5 to impart a thrust force to it driving the passage of the display organs 32, 33 and of their display portions 32*a*, 33*a* in particular from the resting position shown in FIG. 3A to the display position shown in FIG. 3B.

Figure 4:
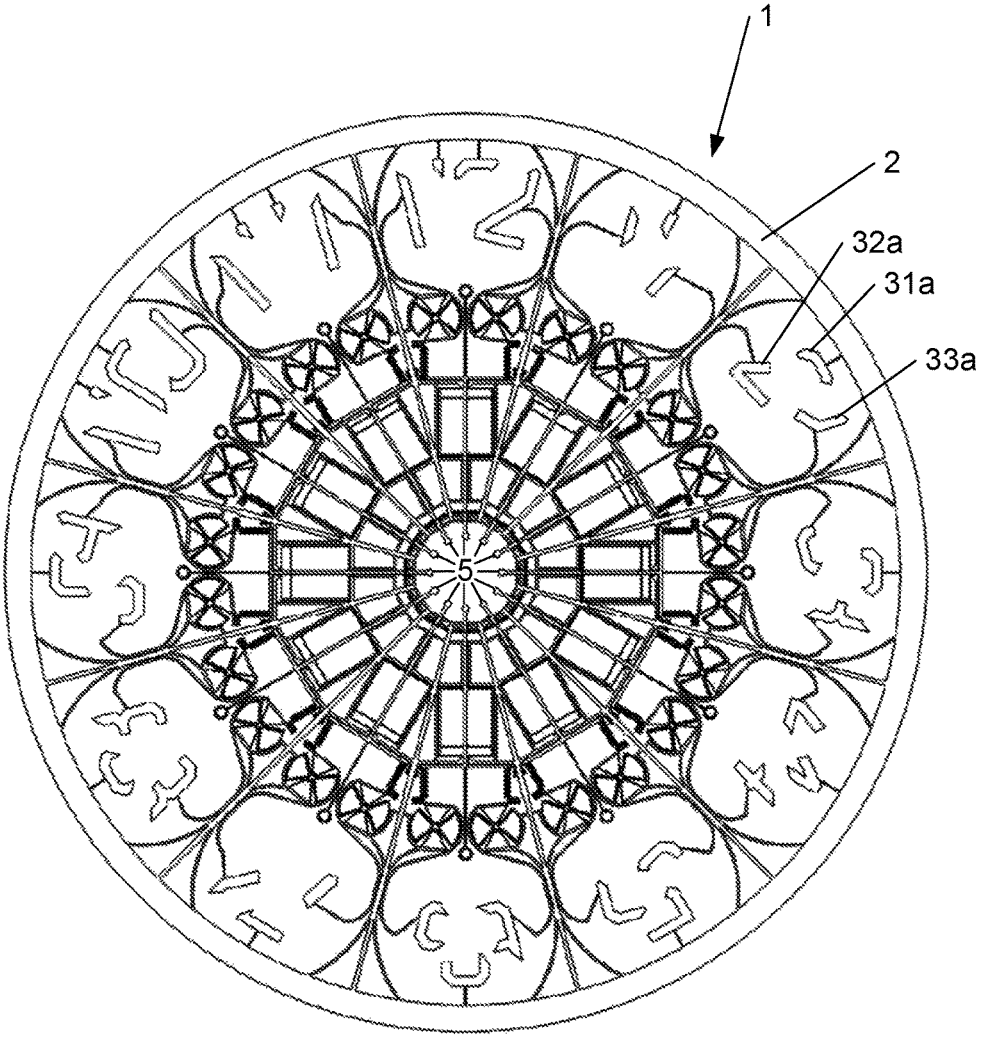
FIG. 4 shows a top view of a display module according to the present invention in a $4^{th}$ embodiment, in the resting position, the display module making up a complete display dial of the hour for a timepiece according to the principle of the unitary display module of FIGS. 3A and 3B.

The structural and functional principles of the display module 1 of FIGS. 3A and 3B can be extended to the production of a circular display module as shown in FIG. 4, similar to that of FIG. 2. Such a display module may in particular serves as a base for producing a dial for a timepiece, such as a watch or clock, for the display, in animated form, of the time with an actuating cam of the push-pieces 5 arranged rotatably at the center of the display module is kinematically connected to the hour-wheel of a clockwork movement.

While illustrative embodiments have been illustrated and described, it will be appreciated that various changes can be made therein without departing from the spirit and scope of the invention.

The embodiments of the invention in which an exclusive property or privilege is claimed are defined as follows:

1. A display module including a fixed frame and at least two substantially rigid display organs, wherein:

each of said at least two display organs includes a display portion for displaying a pattern, said display portions being complementary to one another such that said display portions altogether form said pattern in at least one relative position of the at least two display organs, at least one of the at least two display organs being secured and movable relative to the frame via at least one deformable link between a resting position, in which the display portions are separate from one another, and a display position, in which said display portions are adjoined to one another to form and display said pattern, the at least one of the at least two display organs that is movable relative to the frame is arranged to cooperate with an actuating push-piece in order to move the at least one display organ that is movable relative to the frame from said resting position toward said display position by elastic deformation of said at least one deformable link, wherein the display organs, the frame, and the at least one deformable link form a monolithic piece of material.

2. The display module according to claim 1, further comprising n display organs, wherein n is an integer greater than 1, and wherein at least one display organ is secured to the frame and immobile relative thereto.

3. The display module according to claim 1, wherein the actuating push-piece is movable relative to the frame via a deformable link.

4. The display module according to claim 1, wherein at least one of the at least two display organs is linked to the frame by a plurality of deformable links.

5. The display module according to claim 1, wherein the deformable link is made up of flexible blades with a width comprised between 2 and 50 microns, the thickness of the frame and display organ(s) being greater than 30 microns.

6. The display module according to claim 1, wherein the display module is made up of monocrystalline or polycrystalline silicon.

7. A display system including a display module according to claim 1 and an actuating device arranged to transmit a displacement force on the actuating push-piece so as to cause a movement of the movable display organs from the resting position to the display position.

8. The display system according to claim 7, wherein the actuating device includes a cam or a catch, said actuating device being rotatable around a rotation staff and arranged relative to the actuating push-piece such that said cam or said catch exerts, in at least one angular position around a rotation staff, on the actuating push-piece, a force able to mobilize said push-piece.

9. The display system according to claim 7, further including a plurality of display modules.

10. The display system according to claim 9, wherein the display modules are arranged concentrically around the actuating device rotatably arranged around a staff such that the staff successively cooperates with an actuating push-piece of each of the display modules.

11. The display system according to claim 7, wherein the actuating device is a contactless actuating device by electrostatic, thermal, or magnetic effect on the actuating push-piece of the display module.

12. A timepiece, comprising the display system according to claim 7.

13. The timepiece according to claim 12, characterized in that the actuating device is kinematically connected to an hour-wheel and/or to a minute-wheel of a clockwork movement and the display module is arranged to display a time.

* * * * *